United States Patent [19]

Habu et al.

[11] 4,160,669

[45] Jul. 10, 1979

[54] ARGON LASER FLASH EXPOSURE OF SPECTRALLY SENSITIZED SILVER HALIDE PHOTOGRAPHIC MATERIAL

[76] Inventors: Teiji Habu, 3-31-8, Higashi, Kunitachi-shi, Tokyo; Tomio Nakajima, 3-12-4, Shin-machi, Setagaya-ku, Tokyo; Eiichi Sakamoto, 5-12, Hon-cho, Hanno-shi, Saitama-ken; Noboru Fujimori, 729, Misawa, Hino-shi, Tokyo; Kiyomitsu Mine, 7775, Hino, Hino-shi, Tokyo, all of Japan

[21] Appl. No.: 876,560

[22] Filed: Feb. 9, 1978

Related U.S. Application Data

[63] Continuation of Ser. No. 666,455, Mar. 12, 1976, abandoned.

[30] Foreign Application Priority Data

Mar. 17, 1975 [JP] Japan ..... 50-32004

[51] Int. Cl.[2] ..... G03C 5/04

[52] U.S. Cl. ..... 96/27 E; 96/63; 96/107; 96/108; 96/139; 96/140

[58] Field of Search ..... 96/27 E, 27 H, 107, 96/108, 140, 125, 139, 63

[56] References Cited

U.S. PATENT DOCUMENTS

| | | | |
|---|---|---|---|
| 2,493,748 | 1/1950 | Brooker et al. | 96/140 |
| 2,719,152 | 9/1955 | Jeffreys | 96/140 |
| 3,480,439 | 11/1969 | Kampfer et al. | 96/140 |
| 3,615,644 | 10/1971 | Gotze | 96/140 |
| 3,736,145 | 5/1973 | Hirata et al. | 96/140 |
| 3,790,390 | 2/1974 | Shiba et al. | 96/108 |
| 3,804,634 | 4/1974 | Shiba et al. | 96/140 |
| 3,969,116 | 7/1976 | Shiba et al. | 96/27 E |
| 3,971,664 | 7/1976 | Nakazawa et al. | 96/27 H |

*Primary Examiner*—Won H. Louie, Jr.
*Attorney, Agent, or Firm*—Haseltine, Lake & Waters

[57] ABSTRACT

The present invention relates to a silver halide photographic emulsion and particularly to a silver halide photographic emulsion spectrally sensitized for argon laser beam exposure having an improved high spectral sensitivity to flash exposure using flash rays having main emission peaks at wave lengths of 514.5 nm, 488.0 nm and 476.5 nm (argon laser rays).

9 Claims, No Drawings

ARGON LASER FLASH EXPOSURE OF SPECTRALLY SENSITIZED SILVER HALIDE PHOTOGRAPHIC MATERIAL

This is a continuation of U.S. Pat. Application Ser. No. 666,455, filed Mar. 12, 1976, now abandoned.

Recently, new systems for quick information transmission have been rapidly developed. More specifically, methods in which images such as photographs, letters and figures are converted to electric signals for transmission and thereafter converted back to images on photographic materials have been developed as new systems in the field of reprography, e.g., recording, simple plate-making and reproduction. As typical instances of these systems, there can be mentioned the press facsimile system in which image information is electrically transmitted promptly to a remote place and displayed; the high speed photographic typesetting system; the monochromatic film system using the scanning method; the lith film system for a dot-forming machine using the scanning method; the computor output recording system; the recording and reproducing system for holography; and the photomask printing system in the IC production process.

The light source for use in these quick information transmission systems is required to have such a property that the illuminance is changed faithfully depending on the change in the signal current. As the light source meeting this requirement, there are employed a xenon flash light, an arc light, a high pressure mercury lamp, a xenon lamp, a flying spot of a phosphor substance of a cathode ray tube and a laser ray, and a light source device is constructed by combining such high illuminance light source with a high speed shutter.

As one of laser beams broadly used for the facsimile system, there can be mentioned argon gas laser beam generated by using argon gas as a laser oscillation medium, and it attracts attentions in the art as well as laser beams generated by using neon-helium, krypton, carbon dioxide gas and ruby as laser oscillation media.

These laser beams are so-called coherent rays having a uniform phase in the single frequency and a sharp orientation. Accordingly, light-sensitive silver halide photographic materials to be exposed to rays from these light source should have a spectral sensitivity in conformity with the emission wave length of the laser used. In the case of argon laser beams, silver halide photographic materials should have a high spectral sensitivity to rays having wave lengths of 514.5 nm, 488.0 nm and 476.5 nm, and they need not be spectrally sensitized to rays of other wavelength regions and those having a much reduced sensitivity to these other rays are easy to handle.

Since the time for light exposure of a photographic material by using such argon laser light source is as short as $10^{-5}$to $10^{-7}$ second, a silver halide photographic material which has excellent characteristics for a high-illuminance and short-time exposure is required. However, as is well-known in the art, a phenomenon called "reciprocity law failure" is observed as an inherent property of the silver halide photographic emulsion, and in the case of an extremely short exposure time (shorter than $10^{-3}$ second) by a high illuminance light source (as in the case of long-time exposure (more than 10 seconds) using a low illuminance light source), the sensitivity, gamma and density becomes lower than in the case of an ordinary exposure time (about 10−2 second). This phenomenon is often influenced by not only photographic characteristics of the silver halide per se but also the kind of the emulsion, the emulsion-preparing technique, the physical and chemical ripening of the emulsion, the kinds of additives and other factors. In view of this phenomenon, an excellent sensitizing technique should be applied to production of a photosensitive material for facsimile utilizing argon laser beams so as to improve high-illuminance and short-time exposure characteristics.

It is well-known in the art that the spectral sensitizing activity on a silver photographic emulsion is greatly changed by a slight difference of the structure in the spectral sensitizer. It is an unexpected fact that specific sensitizing dyes employed for the present invention give a silver halide photographic emulsion very excellent spectral sensitivity characteristics to flash exposure using argon laser beams.

Recently, some spectral sensitizing techniques have been proposed in the technical field to which the present invention is directed, but according to any of these proposals, a silver halide photographic material having excellent photographic characteristics of high density and high gamma has not been obtained.

It is the first object of the present invention to provide a silver halide photographic emulsion having an improved high sensitivity to an argon laser beam exposure.

The second object of the present invention is to provide a silver halide photographic emulsion for argon laser beam exposure capable of providing a high resolving power necessary for recording and reproducing high density information.

The third object of the present invention is to provide a silver halide photographic emulsion having excellent characteristics for high-illuminance and short-time exposure, giving high density and high contrast, providing stable characteristics on the lith-type development, and being suitably used for lith-type films which is used to produce so-called a dot image obtained by using a forming machine such as scanner.

The fourth object of the present invention is to provide a silver halide photographic emulsion for argon laser beam exposure which has a good adaptability to quick development system.

The foregoing objects and other objects of the present invention described below can be attained by incorporating in a silver halide photographic emulsion at least one of sensitizing dyes represented by the following general formula:

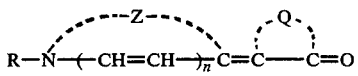

wherein Z represents non-metallic atoms necessary to complete a heterocyclic nucleus selected from the class consisting of a pyridine nucleus, a pyrroline nucleus, an oxazole nucleus, a thiazole nucleus and a selenazole nucleus, which may have a substituent; Q represents non-metallic atoms necessary to complete a heterocyclic nucleus selected from the class consisting of rhodanine necleus, thiohydantoin nucleus, a thiooxazolidinediene nucleus and a thioselenazolidinedione nucleus, which may have a substituent; R represents a member selected from an alkyl, an alkenyl, an aryl or a substituted alkyl, and n represents an integer of 0 or 1.

In the sensitizing dye of the present invention represented by the above general formula, the heterocyclic ring containing Z can have such substituents as lower alkyl, lower alkoxy, aryl, and/or halogen, and a benzene or naphthalene ring may be fused to this heterocyclic ring. A substituent such as mentioned above may be introduced into such fused benzene or naphthalene ring. The heterocyclic ring containing Q, can also have substituents such as lower alkyl, lower alkoxy, sulfoalkyl, carboxyalkyl, hydroxyalkyl, allyl and aryl. As typical instances of R in the general formula mentioned above are methyl, ethyl, propyl, butyl, β-sulfoethyl, γ-sulfopropyl, δ-sulfobutyl, γ-sulfobutyl, β-(γ-sulfopropoxy)ethyl, β-(δsulfothiobutoxy)ethyl, β-hydroxyethyl, β-hydroxy-γ-sulfopropyl, carboxymethyl, β-carboxyethyl, allyl, phenyl, p-chlorophenyl, p-carboxyphenyl, and so forth.

The objects of the present invention can be attained only by incorporating in a silver halide photographic emulsion at least one of sensitizing dyes represented by the above general formula, and the resulting emulsion is coated on a suitable support to prepare a silver halide photographic light-sensitive material.

The typical instances of the sensitizing dye represented by the above general formula are as follows:

(1)

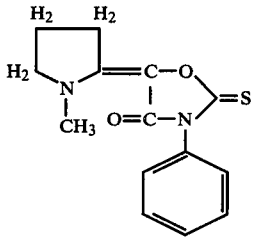

(2)

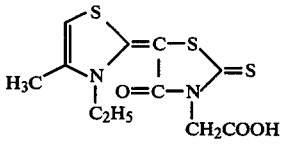

(3)

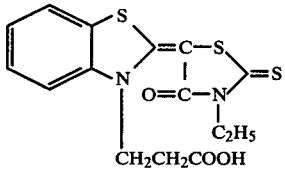

(4)

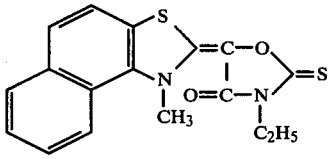

(5)

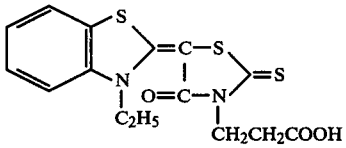

-continued (6)

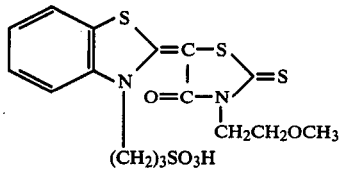

(7)

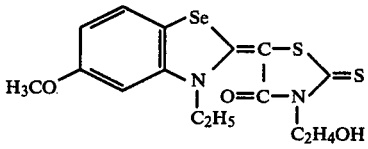

(8)

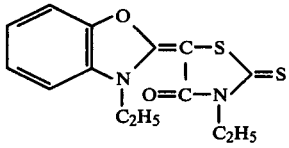

(9)

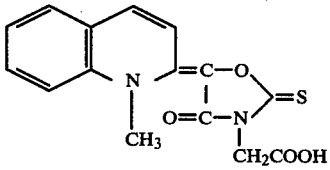

(10)

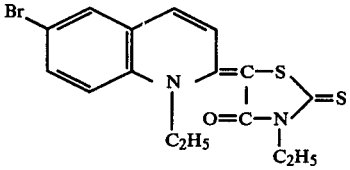

(11)

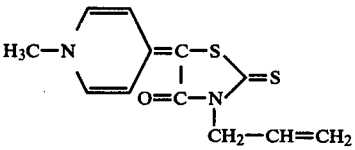

(12)

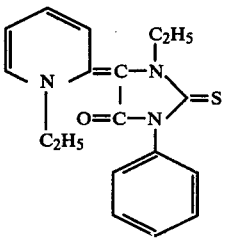

(13)

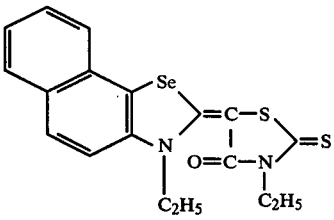

-continued (14)

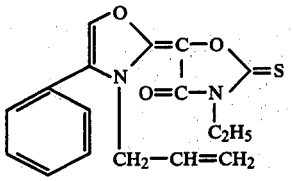

(15)

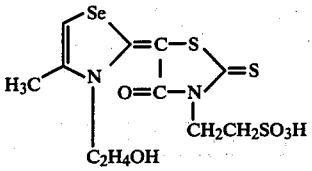

(16)

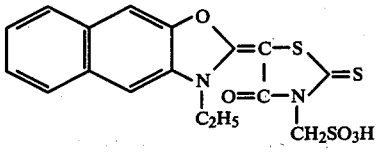

(17)

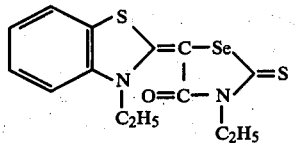

These sensitizing dyes can be synthesized, for example, according to the process disclosed in F. M. Hamer, "The Cyanine Dyes and Related Compounds", 1964, published by Inter-Science Publishers.

Incorporation of a sensitizing dye represented by the above general formula into a silver halide emulsion may be accomplished by dissolving the sensitizing dye in a solvent such as methanol, ethanol, dimethylsulfoxide, an aqueous solution of an aliali or a mixture thereof and adding the solution at an optional stage. In general, the sensitizing dye is added to the silver halide emulsion during any period from the time of completion of chemical ripening to the time just before coating. The amount of the sensitizing dye added is changed depending on the kinds of the sensitizing dye and emulsion and the like, but in general, the amount added can be chosen within a broad range of from 3 to 500 mg per mole of the silver halide and an optimum amount can be determined by a simple test.

As the silver halide for the silver halide emulsion of the present invention for argon laser beam exposure, there can be used any of customarily used silver halides, such as silver bromide, silver chloride, silver iodobromide, silver chlorobromide and silver chloroiodobromide. Effects of the present invention are especially conspicuous when a silver halide emulsion containing silver chloride is employed.

The grain size of the silver halide is not so material. However, is is generally preferred that the grain size be not larger than 3$\mu$, and especially good results are obtained when the grain size is 0.1 to 1$\mu$.

In the silver halide photographic emulsion of the present invention, the high-illuminance and short-time exposure characteristics can be further improved by incorporation of a compound containing a metal of Group VIII of the Periodic Table. As the metal of Group VIII of the Periodic Table, there can be mentioned iron, cobalt, nickel, ruthenium, rhodium, palladium, osmium, iridium and platinum. Compounds containing these metals, which are preferably used in the present invention, include ferric chloride, potassium ferricyanide, cobalt chloride, cobalt nitrate, nickel chloride, nickel sulfate, ruthenium chloride, ruthenium hydroxide, rhodium chloride, ammonium hexachlororhodate, palladium chloride, palladium nitrate, potassium hexachloropalladate, osmium chloride, iridium chloride ($IrCl_3$ or $IrCl_4$), potassium chloroiridate, ammonium hexachloroiridate, ammonium hexachloroplatinate and potassium hexachloroplatinate. It is preferred that such compound be added in an amount of $10^{-8}$ to 10 $-6$ mole per mole of the silver halide at the step of forming particles of the silver halide emulsion or during or after the step of physical or chemical ripening. Sometimes desensitization or reversal is readily caused to occur according to the kind of the metal of the compound used, or the method for preparation or development of the emulsion. In such a case it is preferred that the compound be added in an amount of 10$-$8 to 10$-$7 mole per mole of the silver halide prior to the physical ripening.

A hydropholic binder can be incorporated in the silver halide emulsion of the present invention. As suitable binders, there can be mentioned, for example, gelatin, acetylated gelatin, phthalated gelatin, other gelatin derivatives, water-soluble cellulose derivatives, polyvinyl alcohol, and polymers bonded by hydrophilic synthetic or natural macromolecular compounds.

The emulsion of the present invention may be chemically sensitized by noble metal sensitizers, sulfur sensitizers, active or inactive selenium sensitizers, reducing sensitizers and polyalkelene oxide sensitizers for example. Further, it is preferred to use a development accelerator. For examples, thioether type compounds, quaternary ammonium salts and polyalkylene oxide compounds are used in the present invention, and development accelerators disclosed in Japanese Patent Publications No. 13822/68 and No. 11116/72 are especially preferred. Still further, the photographic emulsion of the present invention may be stabilized by azoles, azaindenes and mercaptans. Still further, other photographic additives can be incorporated into the photographic emulsion of the present invention; for example, wetting agents (e.g., dihydroxyalkanes, cyclohexane diols, acetylene alchols and water-dispersible fine particulate macromolecular compounds obtained by emulsion polymerization); plasticizers; agents for improving the physical properties of the coating; gelatin hardener such as aldehydes, ethyleneimines, ketones, carboxylic acid derivatives, sulfonic acid esters, sulfonyl halides and vinyl sulfones; coating aids such as saponin and sulfosuccinates; fluorescent or non-fluorescent whitening agents such bistriazinylaminostilbene compounds; hypersensitizers such as polyhydroxybenzene-formalin novolak resin condensates, antitatic agents; UV absorbers; dot quality-improving agents; anti-foggants; internal type color formers; color toning agents; and so forth.

If desired, other appropriate sensitizing dyes such as cyanine, merocyanine, composite cyanine or styryl dyes can be used in combination with the sensitizing dye represented by the above general formula, so far as there is no adverse effects on the emulsion of the present invention, and additional spectral sensitizatior can be obtained thereby.

In order to facilitate handling of the silver halide photographic emulsion of the present invention in dark room lights, a dye, for example, one disclosed in Japanese Patent Application Laid-Open Specification No. 10918/73, may be incorporated as a photographic dye.

The silver halide emulsion of the present invention may be coated according to a customary method onto suitable supports, for example, papers such as baryta paper and polyethylene-coated paper, glass sheets, cellulose acetate film, cellulose nitrate film, polystyrene film, polyester film such as polyethylene terephthalate film, polycarbonate film and polyamide film.

A silver halide photographic material which comprises the silver halide emulsion layer made of the present invention can be adapted not only to an ordinary development process but also a diffusion transfer process or a so-called quick procesing method in which a developer is incorporated in advance into the photographic material.

The present invention will now be illustrated in detail by reference to the following Examples that by no means limit the scope of the invention.

EXAMPLE 1

A silver iodobromide emulsion having an average grain size of 0.7μ and containing 1.5 mole % of silver iodide was prepared according to a customary method, and sodium chloroaurate, sodium thiocyanate and sodium thiosulfite were added to the emulsion to effect chemical ripening. Then, the sensitizing dyes of the present invention as exemplified above were added in an amount of $10^{-3}$ mole per mole of the silver halide in the form of a solution in methanol. Then, saponin, mucochloric acid and 4-hydroxy-6-methyl-1,3,3a,7-tetrazaindene were added to the emulsion, and the pH was adjusted to 6.5 by sodium carbonate, to thereby form a silver halide emulsion. The emulsion was coated and dried on a subbed cellulose acetate film support to form a sample. Instead of the sensitizing dyes of the present invention, a comparative dye (A) having the following structure:

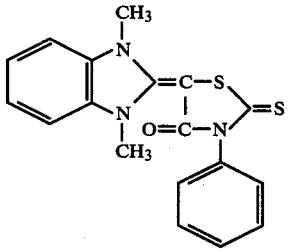

was added and an emulsion was prepared in the same manner as above. Further, an emulsion was prepared in the same manner without incorporation of a sensitizing dye. Each of these comparative emulsions was coated and dried on the same support as described above to form a comparative sample.

Each of these samples was exposed by the following two methods using an interference filter and an argon laser beam.

Exposure Method 1

By using a sensitometer (Model KS-4 manufactured by Konishiroku Photo Industry Co., Ltd.; tungsten light source of a color temperature of 2854° K) to which an interference filter allowing passage of red light (transmission maximum wavelength of 515 nm) was attached, the sample was exposed for 1 second through a neutral gray wedge.

Exposure Method 2

By using an argon laser oscillator (Model JLG-A4 manufactured by Nippon Electric Company, Ltd.), the sample was exposed for $10^{-5}$ second to an argon laser beam of 514.5 nm through a neutral gray wedge.

The exposure quantity was adjusted by using a neutral gray filter so that the same exposure quantity was attained in both the exposure methods 1 and 2.

The exposed sample was developed at 25° C. for 5 minutes with a liquid developer having the following composition.

| Composition of Liquid Developer | |
|---|---|
| Metol | 3 g |
| Anhydrous sodium sulfite | 50 G |
| Hydroquinone | 6 g |
| Sodium carbonate (monohydrate) | 29.5 g |
| Potassium bromide | 5 g |
| Water to make total one liter | |

A photographic characteristic curve was obtained by using an automatic densitometer (manufactured by Konishiroku Photo Industry Co., Ltd.), and the sensitivity was determined as a reciprocal number of the exposure quantity necessary for providing an optical density of (fog−0.5). The results obtained are shown in Table 1. The sensitivity is expressed as a relative speed calculated based on the assumption that the speed of the dye-free sample exposed according to the exposure method 1 using the interference filter is 100.

Table 1

| Sample No. | Dye | Relative Speed: Exposure Method 1 | Relative Speed: Exposure Method 2 |
|---|---|---|---|
| 1 | (4) | 105 | 98 |
| 2 | (7) | 110 | 100 |
| 3 | (11) | 115 | 115 |
| 4 | (14) | 115 | 105 |
| 5 | Comparative Dye (A) | 75 | 37 |
| 6 | Not added | 100 | 53 |

From the results shown in Table 1, it will readily be understood that the silver halide photographic emulsion of the present invention has a higher sensitivity to argon laser beam exposure than the emulsion comprising Comparative Dye (A).

EXAMPLE 2

A silver chlorobromide emulsion having an average grain size of 0.2μ and containing 25 mole % of silver bromide was prepared according to a customary method. At the step of forming silver halide particles, ammonium hexachloroiridate was added in an amount of $10^{-7}$ mole per mole of the silver halide. Chloroauric acid and sodium thiosulfite were added to the emulsion to effect chemical ripening. A sensitizing dye illustrated above was added to the emulsion in an amount indicated in Table 2 in the form of a solution in methanol. Then, polyethylene oxide having an average molecular weight of 4000, formalin, saponin and 1,3,3a,7-tetrazaindene were added to the emulsion to form a silver halide emulsion. The emulsion was coated on a subbed polyethylene terephthalate film support in a dry thickness of 5μ, followed by drying, to thereby form a sample.

Each of the so obtained samples was exposed according to the exposure method 1 or 2 described in Example 1 and developed at 20° C. for 2 minutes 10 seconds with a lith-type liquid developer (recipe D-85 of Eastman Kodak Co.), and the sensitivity was determined according to the same method as described in example 1 to obtain results shown in Table 2. The sensitivity was expressed as a relative speed calculated based on the assumption that the speed of the sample containing 60 mg of Comparative Dye (A) and exposed according to the exposure method using the interference filter is 1.

Table 2

| Sample No. | Dye | Amount Added (mg per mole of silver halide) | Relative Speed Exposure Method 1 | Relative Speed Exposure Method 2 |
|---|---|---|---|---|
| 7 | (3) | 30 | 15 | 17 |
| 8 | (3) | 60 | 20 | 20 |
| 9 | (3) | 90 | 7 | 20 |
| 10 | (10) | 30 | 20 | 17 |
| 11 | (10) | 60 | 25 | 20 |
| 12 | (10) | 90 | 17 | 20 |
| 13 | (15) | 30 | 30 | 20 |
| 14 | (15) | 60 | 25 | 23 |
| 15 | (15) | 90 | 23 | 25 |
| 16 | Comparative Dye (A) | 30 | 7 | 5 |
| 17 | Comparative Dye (A) | 60 | 1 | 0.5 |
| 18 | Comparative Dye (A) | 90 | 0.5 | 0.5 |
| 19 | Not added | — | 2 | 1.5 |

As is apparent from the results shown in Table 2, the silver halide photographic emulsion of the present invention has a high spectral sensitivity to argon laser beam exposure also when developed according to the lith-type development method. As is seen from the fact that the same sensitizing effect can be attained by addition of 60 mg of the dye (3) and 30 mg of the dye (15) the amount added of the sensitizing dye is not particularly critical. However, in the case of flash exposure, it is generally preferred that the amount added of the sensitizing dye be larger than in the case of ordinary exposure. In general, the amount added of the sensitizing dye is determined while taking not only the sensitizing efficiency at the exposure step but also the development-inhibiting effect at the development step into account.

EXAMPLE 3

Amoung the samples exposed according to the exposure method 2 in Example 2, those containing the dye in an amount of 60 mg per mole of the siler halide were developed at 27° C. with the same liquid developer as used in Example 2 by employing an automatic developing machine (Model G-17 manufactured by Konishiroku Photo Industry Co., Ltd.). Then, in the same method as described in Example 2, the relative speed, the gamma in the linear portion and the dot quality were determined. While the development time was changed within a range of 1 minute and 20 seconds to 2 minutes and 20 seconds with intervals of 10 seconds, the sample with most reduced fringes was chosens and the values were determined with respect to this sample. The dot quality was determined by examining the clearness of the dot image under a microscope and evaluated on a 5-graded scale (5 denoting best and 1 denoting bad). Results are shown in Table 3.

Table 3

| Sample No. | Relative Speed* | Gamma | Dot Quality |
|---|---|---|---|
| 8 | 50 | >12 | 4 |
| 11 | 60 | >12 | 4 |
| 14 | 55 | >12 | 5 |
| 17 | 13 | 3 | 2 |
| 19 | 10 | 3 | 2 |

*The relative speed was determined based on the same sample as the basic sample used in Example 2.

From the results shown in Table 3, the sample according to the present invention has excellent photographic characteristics also when developed by the quick lith-type development method.

What we claim is:

1. A process for forming an image by use of a silver halide photographic material comprising a silver halide photographic emulsion layer to be used for argon laser beam exposure which process comprises imagewise exposing the photographic material to argon laser beam light for $10^{-5}$ to $10^{-7}$ second, and developing said material said photographic emulsion layer comprising at least one sensitizing dye represented by the following formula:

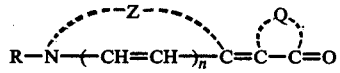

wherein Z, when taken together with the atoms to which it is attached, form a heterocyclic nucleus selected from the group consisting of a pyridine nucleus, a pyrroline nucleus, an oxazole nucleus, a thiazole nucleus and a selenazole nucleus, said nuclei having a substituent or substituents selected from the group consisting of hydrogen, lower alkyl, lower alkoxy, and aryl or said nuclei are fused with a benzene or naphthalene ring which ring can have a substituent or substituents selected from the group consisting of hydrogen, lower alkyl, lower alkoxy, and halogen; Q, when taken together with the atoms to which it is attached, form a heterocyclic nucleus selected from the group consisting of a rhodanine nucleus, a thiohydantoin nucleus, a thiooxazolidinedione nucleus and a thioselenazolidinedione nucleus, said nuclei having a substituent or substituents selected from the group consisting of lower alkyl, lower alkoxy, sulfoalkyl, carboxyalkyl, hydroxyalkyl, allyl and aryl; R is selected from the group consisting of alkyl, alkenyl, aryl, substituted alkyl wherein said substituent is selected from the group consisting of β-hydroxyethyl and β-carboxyethyl; and n is an integer of 0 or —1.

2. A Process according to claim 1 wherein said silver halide emulsion is a silver iodobromide emulsion.

3. A Process according to claim 1 wherein said silver halide emulsion comprises silver halide grains containing at least 60 mole percent of silver chloride.

4. A Process according to claim 3 wherein said silver halide grains have an average grain size of 0.1 to 1μ.

5. A Process according to claim 1 wherein said silver halide emulsion further comprises at least one of chemical sensitizers selected from the group consisting of noble metal sensitizers, sulfur sensitizers and selenium sensitizers.

6. A process according to claim 4 wherein said silver halide emulsion further comprises at least one of chemical sensitizers selected from the group consisting of noble metal sensitizers, sulfur sensitizers and selenium sensitizers.

7. A process according to claim 6 wherein said at least one of chemical sensitizers is a combination of the noble metal sensitizers and the sulfur sensitizers.

8. A process according to claim 7 wherein said at least one of sensitizing dyes is selected from the group consisting of:

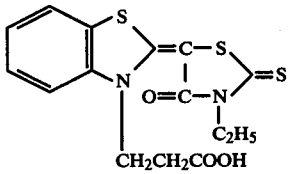

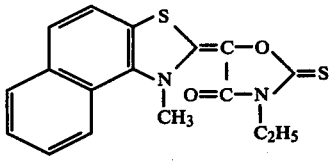

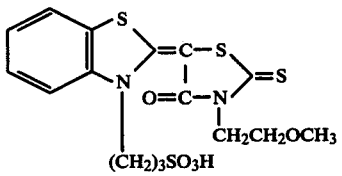

-continued

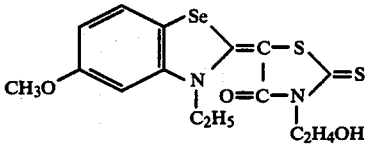

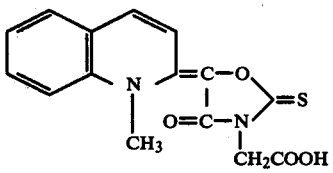

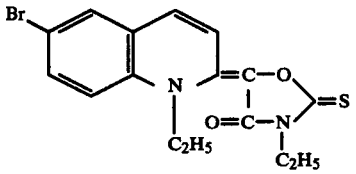

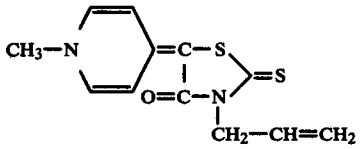

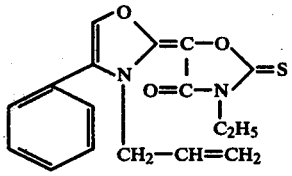

9. A process according to claim 1 wherein the amount of sensitizing dye is from about 3 to 500 mg per mole of the silver halide.

* * * * *